US006113013A

United States Patent [19]

Sand

[11] Patent Number: 6,113,013

[45] **Date of Patent: *Sep. 5, 2000**

[54] NOZZLE AND A METHOD FOR FEEDING THERMOSETTING PLASTIC

[75] Inventor: Kjell Sand, Västra Frölunda, Sweden

[73] Assignee: Aplicator System AB, Mölnlycke, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/043,403

[22] PCT Filed: Sep. 24, 1996

[86] PCT No.: PCT/SE96/01197

§ 371 Date: Jun. 11, 1998

§ 102(e) Date: Jun. 11, 1998

[87] PCT Pub. No.: WO97/11784

PCT Pub. Date: Apr. 3, 1997

[30] Foreign Application Priority Data

Sep. 25, 1995 [SE] Sweden ..... 9503304

[51] Int. Cl.[7] ..... B05B 1/26; F23D 11/36

[52] U.S. Cl. ..... 239/543; 239/552

[58] Field of Search ..... 239/543, 544, 239/548, 552, 433, 550

[56] References Cited

U.S. PATENT DOCUMENTS

| | | | |
|---|---|---|---|
| 2,813,751 | 11/1957 | Barrett | 239/543 X |
| 3,125,298 | 3/1964 | Iwata | 239/543 |
| 5,358,179 | 10/1994 | Lund et al. | 239/544 |

FOREIGN PATENT DOCUMENTS

| | | |
|---|---|---|
| 0046608 | 3/1982 | European Pat. Off. . |
| 0118635 | 9/1984 | European Pat. Off. . |
| 0237352 | 9/1987 | European Pat. Off. . |
| 0293065 | 11/1988 | European Pat. Off. . |
| 9012650 | 11/1990 | WIPO . |

*Primary Examiner*—Andres Kashnikow
*Assistant Examiner*—Sean P. O'Hanlon
*Attorney, Agent, or Firm*—Ostrolenk, Faber, Gerb & Soffen, LLP

[57] ABSTRACT

A nozzle for feeding a mixture of thermosetting plastic and hardener from a mixing chamber, to which feed lines for supply of thermosettable plastic as well as the hardener are connected. The mixing chamber communicates with at least two beam channels (14) having a diameter (b) of 0.5–1.5 mm, which converge in an angle (α) of 70–140° toward a point outside the nozzle. By feeding a mixture of thermosetting plastic and hardener via the nozzle, the mixture has a viscosity of between 150 and 75,000 cpois, and the mixture is extruded from the nozzle with a pressure of 75 to 100 bar.

17 Claims, 1 Drawing Sheet

NOZZLE AND A METHOD FOR FEEDING THERMOSETTING PLASTIC

TECHNICAL FIELD

The present invention refers to a nozzle for feeding a mixture of thermosetting plastic and hardener from a mixing chamber, to which feed lines for supply of. thermosettable plastic as well as hardener are connected. The invention also refers to a method for feeding the mixture.

BACKGROUND OF THE INVENTION

Thermosetting plastics, for instance polyester, urethan and is epoxy can be mixed in fluid state and are fed out by means of a spray-gun, which is equipped with a nozzle providing a defined spray image. In this way, the plastic can be applied, e.g. in a mold for casting plastic products.

Generally, solvent agents are needed as gelling agents in the plastic, to allow it to receive correct viscosity for spraying through the nozzle.

This known technique involves drawbacks, as one generally has to calculate with a certain amount of spillage, when plastic due to an uncontrollable spray image wrongly lands in the mold or next to it. This spillage results in consuming an unnecessary large amount of plastic and also solvent agents. For environmental reasons such spillage should be minimized. Furthermore, it becomes difficult to maintain an even and high production quality, if one does not have control over the amount of plastic fed out per unit area.

The amount of the spillage will not be reduced, if the spray-gun, when spraying according to prior art, is moved closer to the surface to be covered with the thermosetting plastic, as drops of thermosetting plastic hitting a surface with a great force, tend to break into smaller drops, which rebound back towards the spray-gun.

THE TECHNICAL PROBLEM

An object of the present invention is therefore to provide a nozzle of a type described initially, which makes it possible to hold the spray-gun closer to the surface to be covered without risk of back-spray, and which provides a stable and well-defined spray image with distinct edges.

THE SOLUTION

For this object the nozzle according to the invention is characterized in that the mixing chamber communicates with at least two beam channels having a diameter of 0.5–1.5 mm, which converge in an angle of 70–140° towards a point outside the nozzle. The method according to the invention is characterized in that the mixture of plastic and the hardener has a viscosity between 150 and 75,000 cpois, and that the mixture is extruded from the nozzle with a pressure of 75 to 100 bar. Through the present design of the nozzle small plastic drops having uniform size are produced, which move with low speed towards the surface to be covered. In this way a surprisingly well-defined spray image is obtained, without risk of back spray.

DESCRIPTION OF THE DRAWINGS

The invention will be described with reference to an embodiment, which is shown on the enclosed drawings, wherein.

DESCRIPTION OF EMBODIMENT

Figure 3:
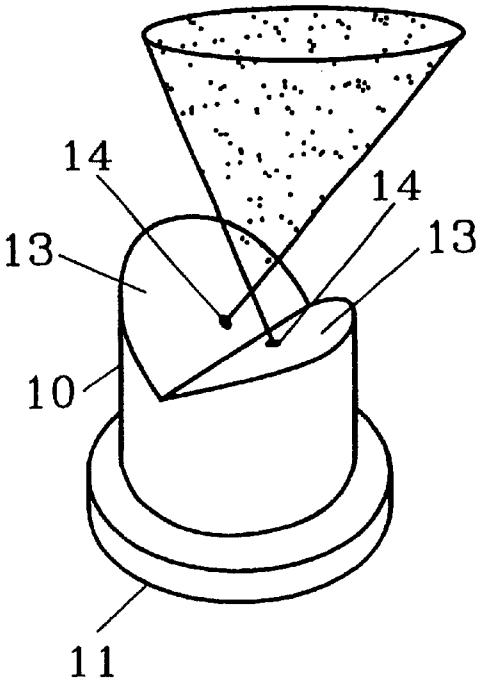
FIG. 3 shows the nozzle schematically in perspective under use.
Figure 2:
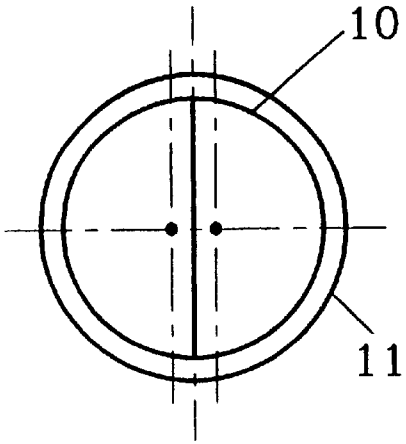
FIG. 2 is a bottom view of the nozzle.
Figure 1:
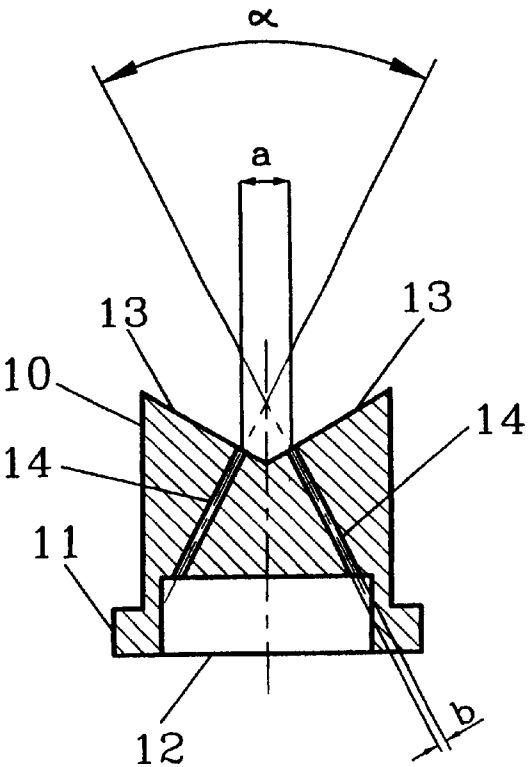
FIG. 1 shows a cross-section of a nozzle according to an embodiment of the invention.

The nozzle in FIG. 1–3 is made of a metallic cylinder 10 with mounting flange 11 formed through turning. The end of the cylinder closest to the flange exhibits a concentric turned space 12. The opposite end of the cylinder is provided with two plane surfaces 13 inclining towards each other, sloping towards the longitudinal axis of the cylinder, with a mutual divergent angle. The angle between said plane surfaces can be between 70° and 140°.

A beam channel 14 is bored in each plane surface 13, each substantially perpendicular to the corresponding plane surface. The two channels 14 are consequently drilled with such a mutual angle $\alpha$ that they converge towards a point outside the nozzle. The angle $\alpha$ between the beam channels is between 70° and 140°. The channels extend into the space 12. Each channel 14 has a diameter b of 0.5–1.5 mm and the distance a between the downstream mouth of the beam channels is 2–5 mm.

The nozzle is used mounted on the outlet from a mixing chamber on the spray-gun, which mixing chamber is fed with plastic and hardener via separate feed channels. Mixture of plastic and hardener should have a viscosity between 150 and 75,000 cpois and feed pressure is suitably between 75 and 100 bar.

The nozzle with this equipment can be used, e.g. in combination with the nozzles for feeding cut reinforcement fibers, to spray composite laminate directly in a mold, for example, by means of an industrial robot. The nozzle can also be used without addition of fibers, to cover a surface with a layer of thermosetting plastic, for example a floor area. The spray image has a narrow elliptical form with distinct edges.

The invention is not limited to the above described embodiment, but variants may occur within the scope of the attached claims. For instance the nozzle may be equipped with more than two spray channels. By using more spray channels the spray image can be affected.

What is claimed is:

1. A nozzle for feeding a mixture of thermosetting plastic and hardener from a mixing chamber, to which feed lines for supply of thermosettable plastic as well as hardener are connected, said nozzle comprising:

a metal cylinder having an input end and an output end;

a mixing chamber formed in the input end of the cylinder;

at least two beam channels communicating with the mixing chamber, the channels being formed as straight bores through the cylinder and inclined toward each other, one end of each bore in communication with the mixing chamber and the other end an unrestricted outlet, said at least two beam channels having a diameter (b) of 0.5–1.5 mm, and converging at an angle ($\alpha$) of 70–140° towards a point outside the nozzle.

2. A nozzle according to claim 1, wherein said beam channels have respective downstream outlets spaced apart by 2–5 mm.

3. A nozzle according to claim 2, wherein said nozzle has a pair of intersecting plane surfaces which respectively contain said downstream outlets and each beam channel extends towards and discharges substantially perpendicular to a corresponding one of said plane surfaces.

4. A nozzle according to claim 3, wherein said plane surfaces intersect at an angle of 70–140°.

5. A nozzle according to claim 1, wherein said beam channels have respective downstream outlets and each said beam channel is straight between said mixing chamber and the corresponding downstream outlet.

6. Method for feeding a mixture of thermosetting plastic and hardener via a nozzle that includes a mixing chamber, to which feed lines for supply of thermosettable plastic as well as hardener are connected, and which chamber communicates with at least two beam channels (14) having a diameter (b) of 0.5–1.5 mm, which converge in an angle ($\alpha$) of 70–140° to a point outside the nozzle, characterised in, that the mixture of plastic and hardener has a viscosity of between 150 and 75,000 cpois, and that the mixture is extruded from the nozzle with a pressure of 75 to 100 bar.

7. A nozzle for feeding a mixture of thermosetting plastic and hardener form a mixing chamber, to which feed lines for supply of thermosettable plastic as well as the hardener are connected, said nozzle comprising:

a metal cylinder having an input end and an output end;

a mixing chamber formed in the input end of the cylinder;

at least two beam channels communicating with the mixing chamber, formed as straight bores through the cylinder and inclined toward each other, one end of each bore in communication with the mixing chamber, and the other end an unrestricted outlet; and a pair of intersecting plane surfaces formed on the output end of the cylinder, each one of said plane surfaces containing a respective downstream outlet corresponding to a respective one of said beam channels, whereby each of said beam channels extends towards and discharges from a corresponding one of said plane surfaces.

8. A nozzle according to claim 7, wherein said plane surfaces intersect at an angle of 70–140°.

9. A nozzle according to claim 8, wherein said beam channels discharge substantially perpendicularly from said corresponding plane surfaces.

10. A nozzle according to claim 9, wherein said downstream outlets are spaced apart by substantially 2–5 mm.

11. A nozzle according to claim 9, wherein each said beam channel is straight between said mixing chamber and the corresponding downstream outlet.

12. A nozzle according to claim 8, wherein said downstream outlets are spaced apart by substantially 2–5 mm.

13. A nozzle according to claim 8, wherein each said beam channel is straight between said mixing chamber and the corresponding downstream outlet.

14. A nozzle according to claim 7, wherein said downstream outlets are spaced apart by substantially 2–5 mm.

15. A nozzle according to claim 7, wherein said beam channels discharge substantially perpendicularly from said corresponding plane surfaces.

16. A nozzle according to claim 15, wherein each said beam channel is straight between said mixing chamber and the corresponding downstream outlet.

17. A nozzle according to claim 7, wherein each said beam channel is straight between said mixing chamber and the corresponding downstream outlet.

* * * * *